US012303034B1

(12) United States Patent
Hogan et al.

(10) Patent No.: US 12,303,034 B1
(45) Date of Patent: May 20, 2025

(54) SYSTEM AND METHOD FOR REDUCING FOOT CONTACT WITH BEDDING

(71) Applicant: Bedcovers Foot Bunker, LLC, Dallas, TX (US)

(72) Inventors: Robert David Hogan, Dallas, TX (US); Conner Holt Anderson, Aubrey, TX (US)

( * ) Notice: Subject to any disclaimer, the term of this patent is extended or adjusted under 35 U.S.C. 154(b) by 0 days.

(21) Appl. No.: 18/937,883

(22) Filed: Nov. 5, 2024

(51) Int. Cl.
*A47C 21/02* (2006.01)
*A47C 21/00* (2006.01)

(52) U.S. Cl.
CPC ..... *A47C 21/024* (2013.01); *A47C 21/022* (2013.01); *A47C 21/02* (2013.01)

(58) Field of Classification Search
CPC ..... A47C 21/024; A47C 21/022; A47C 21/02
USPC ..... 5/505.1, 506.1, 504.1, 503.1
See application file for complete search history.

(56) References Cited

U.S. PATENT DOCUMENTS

| | | | | |
|---|---|---|---|---|
| 2,291,203 | A * | 7/1942 | Bent | A47C 21/024 5/505.1 |
| 4,287,622 | A * | 9/1981 | Lane | A47C 21/024 5/505.1 |
| 4,802,252 | A * | 2/1989 | Marmor | A61G 7/0501 5/505.1 |
| 8,001,632 | B2 * | 8/2011 | Sanders | A61G 7/0501 5/505.1 |
| 2010/0319127 | A1 * | 12/2010 | Sanders | A61G 7/0501 5/505.1 |

* cited by examiner

*Primary Examiner* — Robert G Santos
(74) *Attorney, Agent, or Firm* — Lightfoot & Alford PLLC

(57) ABSTRACT

A bedding standoff includes a first platelike leg, a second platelike leg offset from the first platelike leg, and a crossbar connecting the first platelike leg to the second platelike leg near a top of the first platelike leg and near a top of the second platelike leg. In some embodiments, the first platelike leg is rotatable relative to the crossbar.

8 Claims, 10 Drawing Sheets

SYSTEM AND METHOD FOR REDUCING FOOT CONTACT WITH BEDDING

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

In the field of traditional sleeping systems, mattresses are typically outfitted with mattress covers, sheets, blankets, and comforters, collectively referred to as bedding. In most cases, one or more items of betting rest atop feet of a sleeper. However, some sleepers experience discomfort from unmitigated contact of the bedding with their feet. For example, some sleepers may experience a sensation of overheating of their feet, may experience sensory irritation, or may have a foot injury that should not be in contact with the bedding. While some solutions have provided bedding standoff devices to protect feet from bedding, the devices are unwieldy, not right-sized, cannot easily be erected for use and subsequently be folded so the bed can be made up, or themselves present a hazard to the feet of a sleeper. Accordingly, there is a need for an improved bedding standoff suitable for reducing contact between the feet of sleepers and bedding.

DETAILED DESCRIPTION

In this disclosure, reference may be made to the spatial relationships between various components and to the spatial orientation of various aspects of components as the devices are depicted in the attached drawings. However, as will be recognized by those skilled in the art after a complete reading of this disclosure, the devices, members, apparatuses, etc. described herein may be positioned in any desired orientation. Thus, the use of terms such as "above," "below," "upper," "lower," or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

Figure 1:
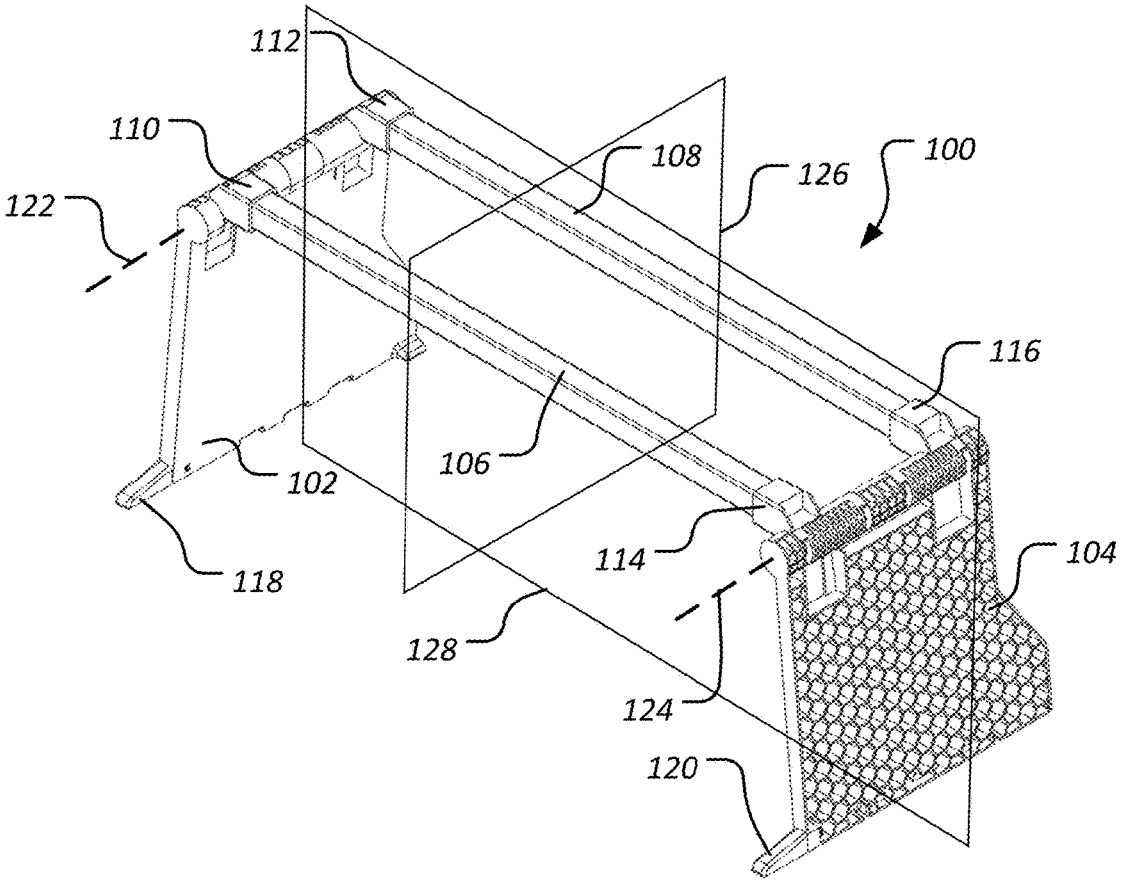
FIG. 1 is an oblique view of a bedding standoff according to an embodiment of this disclosure with the bedding standoff in a deployed configuration.
Figure 2:
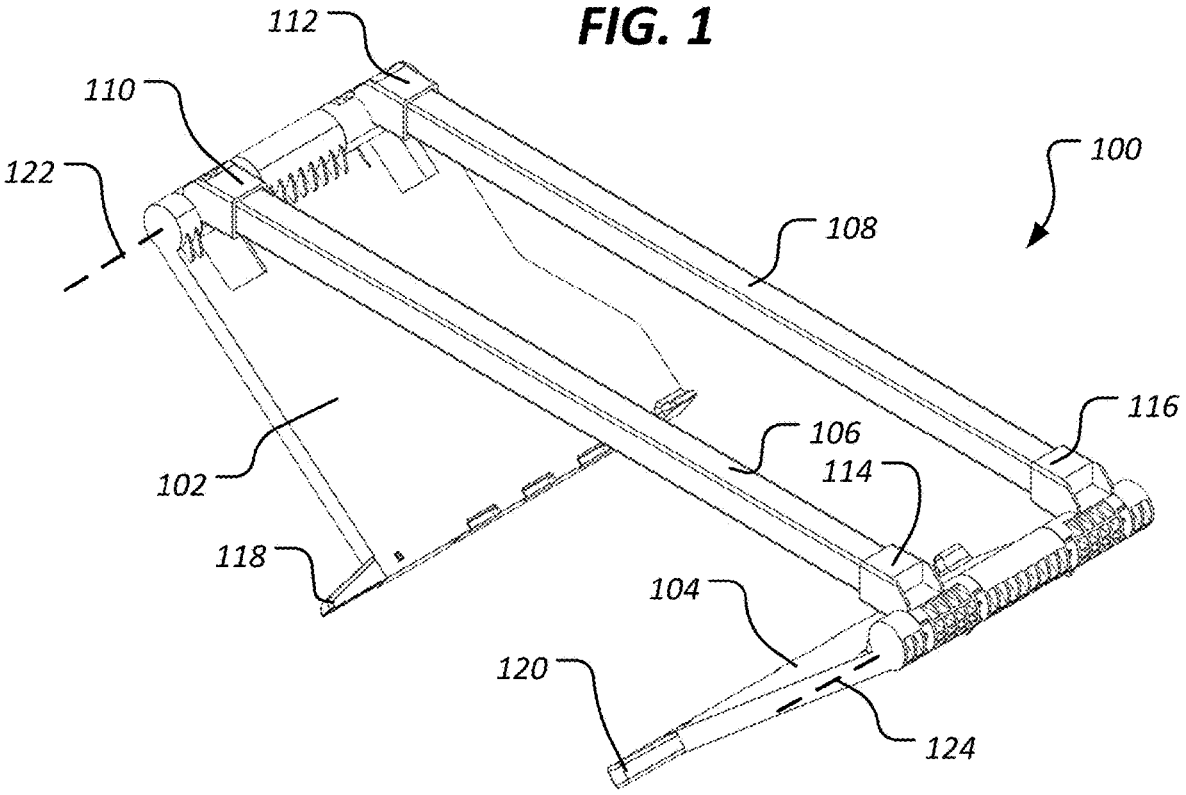
FIG. 2 is an oblique view of the bedding standoff of FIG. 1 in a partially collapsed configuration.
Figure 3:
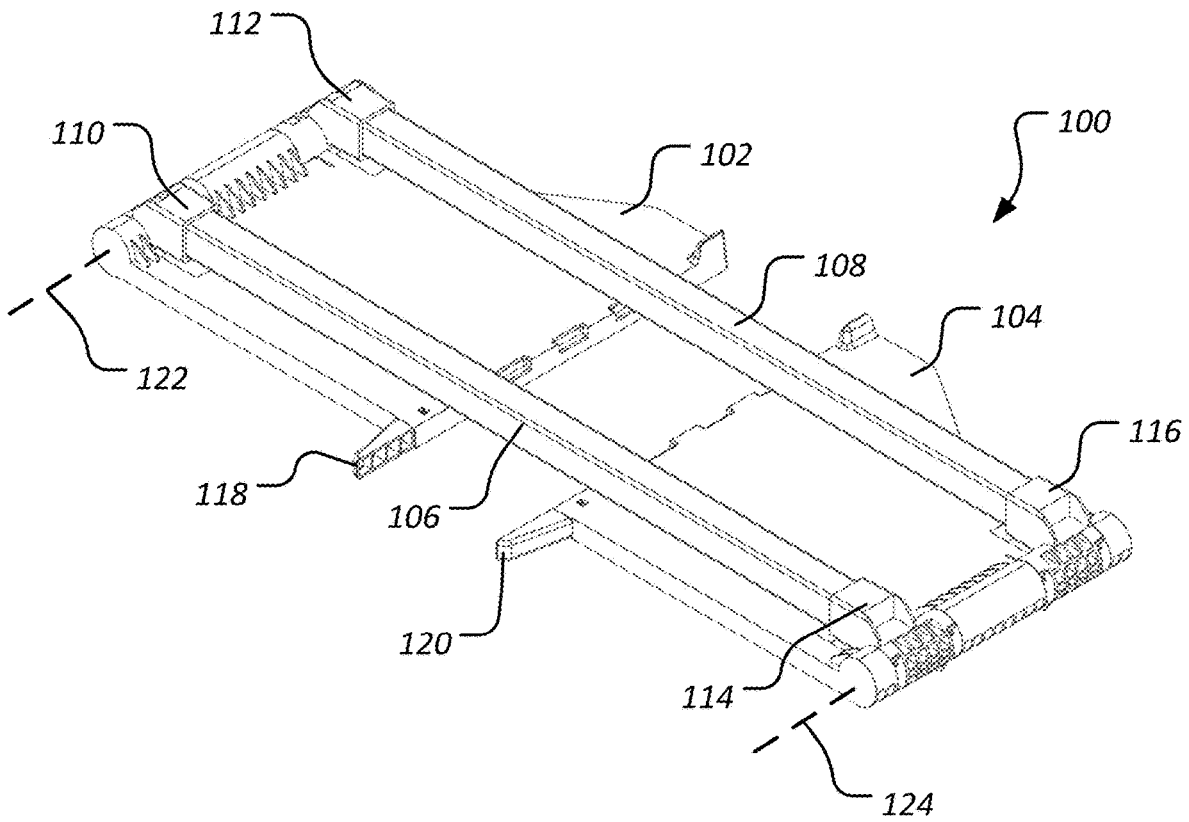
FIG. 3 is an oblique view of the bedding standoff of FIG. 1 in a fully collapsed configuration.

FIGS. 1-3 illustrate a bedding standoff 100, according to an embodiment of this disclosure. FIG. 1 shows bedding standoff 100 in a deployed configuration ready for use, FIG. 2 shows bedding standoff 100 in a partially collapsed configuration, and FIG. 3 shows bedding standoff 100 in a fully collapsed configuration. The fully collapsed configuration is suitable for stowing bedding standoff 100 or otherwise reducing a volumetric footprint occupied by bedding standoff 100 when not in use.

Figure 4:
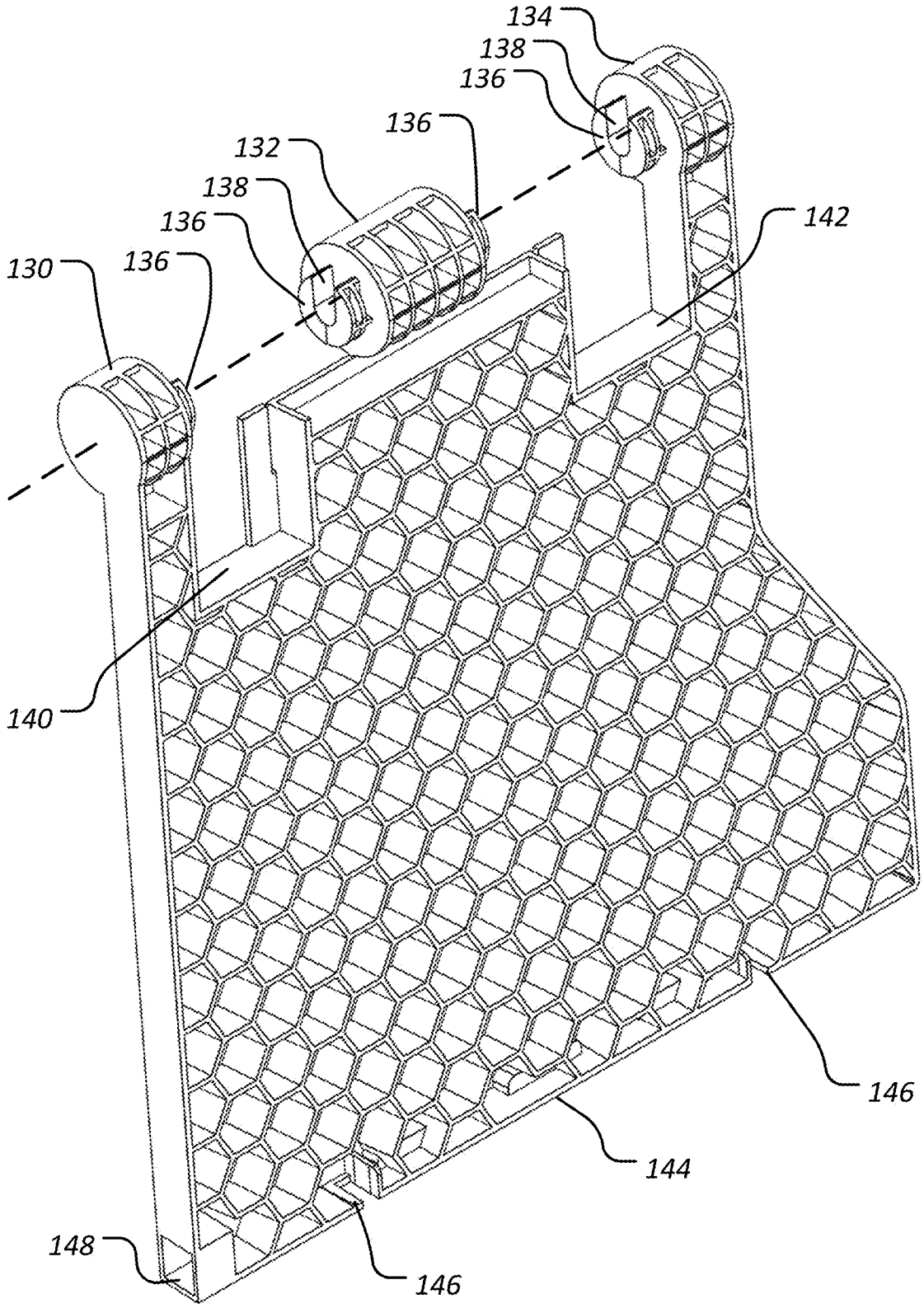
FIG. 4 is an oblique view of a leg of the bedding standoff FIG. 1.
Figure 5:
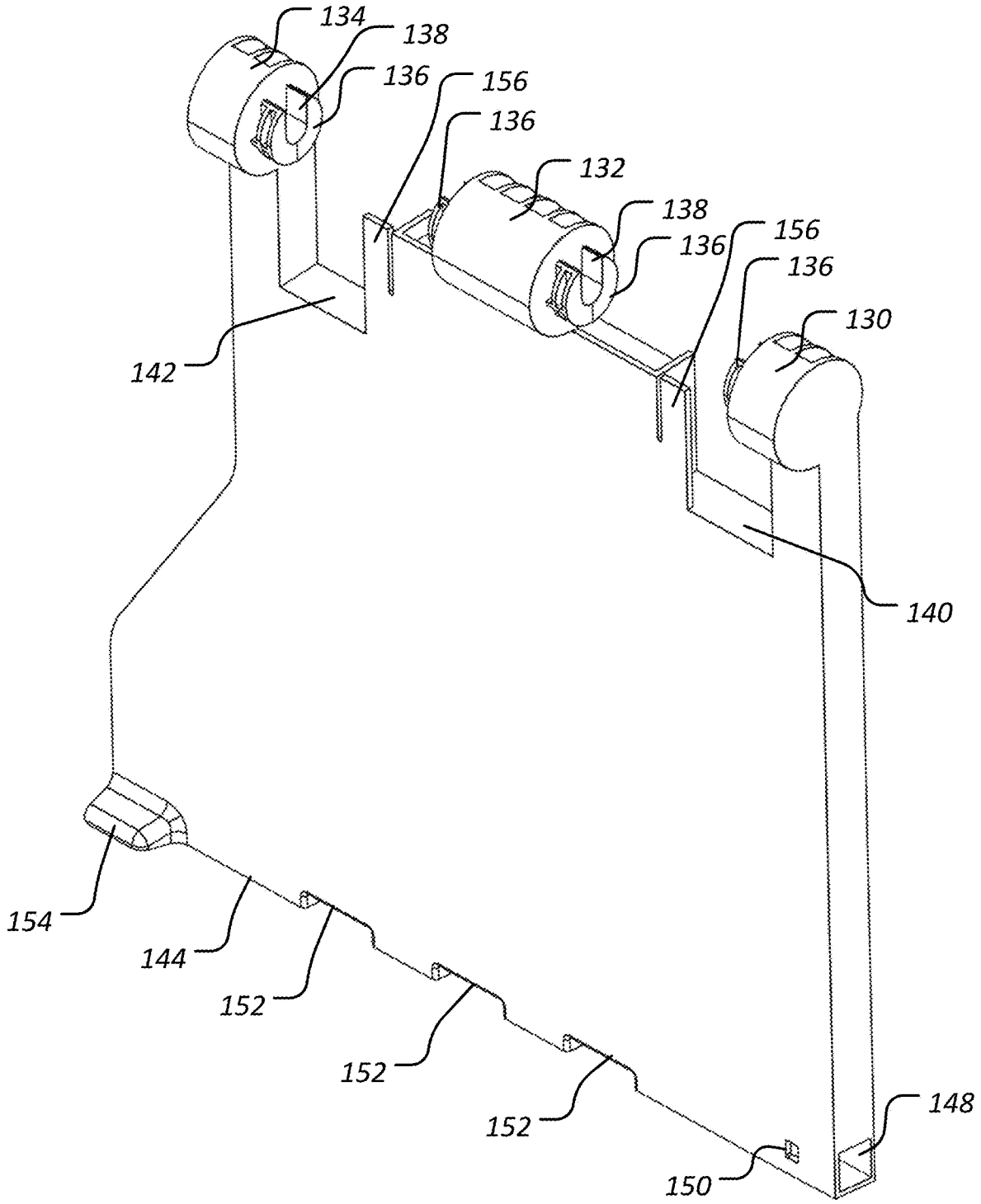
FIG. 5 is another oblique view of the leg of FIG. 4.

Bedding standoff 100 generally comprises a left leg 102, a right leg 104, a front crossbar 106, a rear crossbar 108, a left-front hinge component 110, a left-rear hinge component 112, a right-front hinge component 114, a right-rear hinge component 116, a left stabilizer foot 118, and a right stabilizer foot 120. Most generally, left-front hinge component 110 and left-rear hinge component 112 are rotatably attached to left leg 102 so that they are movable relative to left leg 102 about a left leg axis of rotation 122. Similarly, right-front hinge component 114 and right-rear hinge component 116 are rotatably attached to right leg 104 so that they are movable relative to right leg 104 about a right leg axis of rotation 124. Further, left-front hinge component 110 and the right-front hinge component 114 are joined together by front crossbar 106. Similarly, left-rear hinge component 112 and right-rear hinge component 116 are joined together by rear crossbar 108. Accordingly, when assembled as shown in FIGS. 1-3, bedding standoff 100 is a unitary structure that allows rotation of left leg 102 about left leg axis of rotation 122 and rotation of right leg 104 about right leg axis of rotation 124 to allow selective configuration of bedding standoff 100 in the deployed configuration of FIG. 1, collapsed configuration of FIG. 3, and intermediate configurations therebetween, such as that shown in FIG. 2. It will be appreciated that in this embodiment, the left versus right similarly named components are formed substantially as mirror image components about a left-right bifurcating plane 126. For example, left leg 102 is substantially a mirror construction of right leg 104, left-front hinge component 110 is substantially a mirror construction of right-front hinge component 114, and left-rear hinge component 112 is substantially a mirror construction of right-rear hinge component 116. Accordingly, it will be understood that descriptions of one component having associated mirrored construction components will stand as description for the other substantially mirrored construction component. Further, Referring now to FIGS. 4 and 5, right leg 104 is shown in isolation. Right leg 104 comprises a front knuckle 130, center knuckle 132, and rear knuckle 134, each carrying C-shaped protrusions 136 that form C-slots 138. Right leg 104 further comprises a front cutout 140 and a rear cutout 142, each having an associated flexible tab 156. Still further, right leg 104 comprises a base side 144 having vertical slots 146, side slots 152, a foot receiver 148, foot catch 150, and an integrated foot 154.

Figure 6:
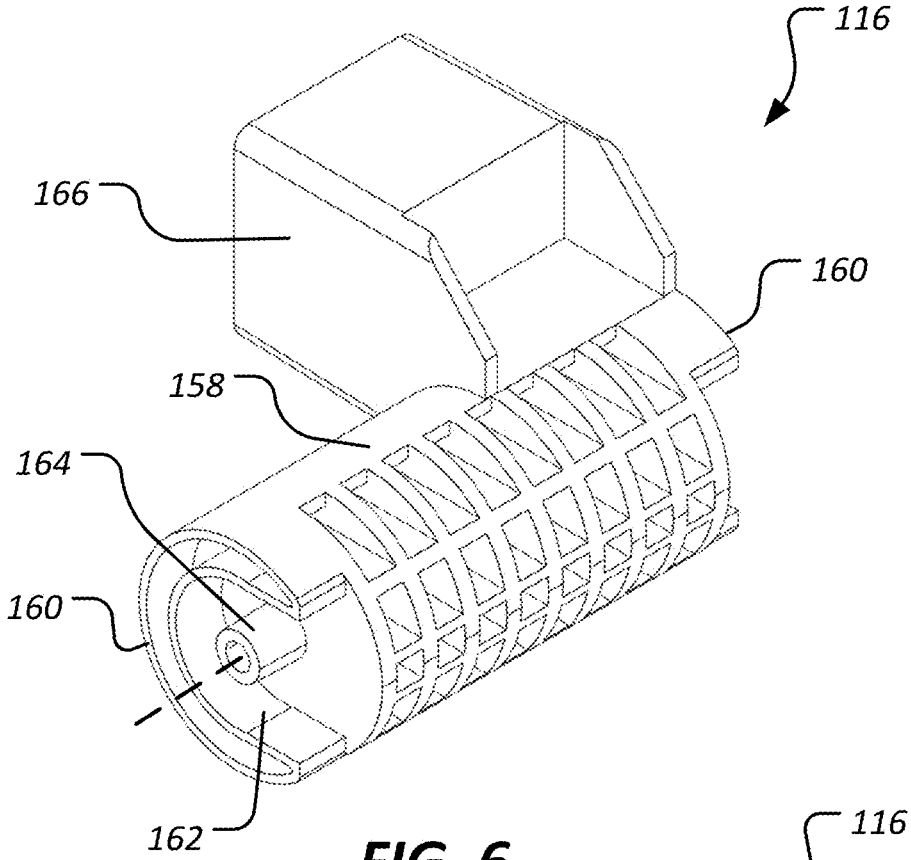
FIG. 6 is an oblique view of a hinge component of the bedding standoff of FIG. 1.
Figure 7:
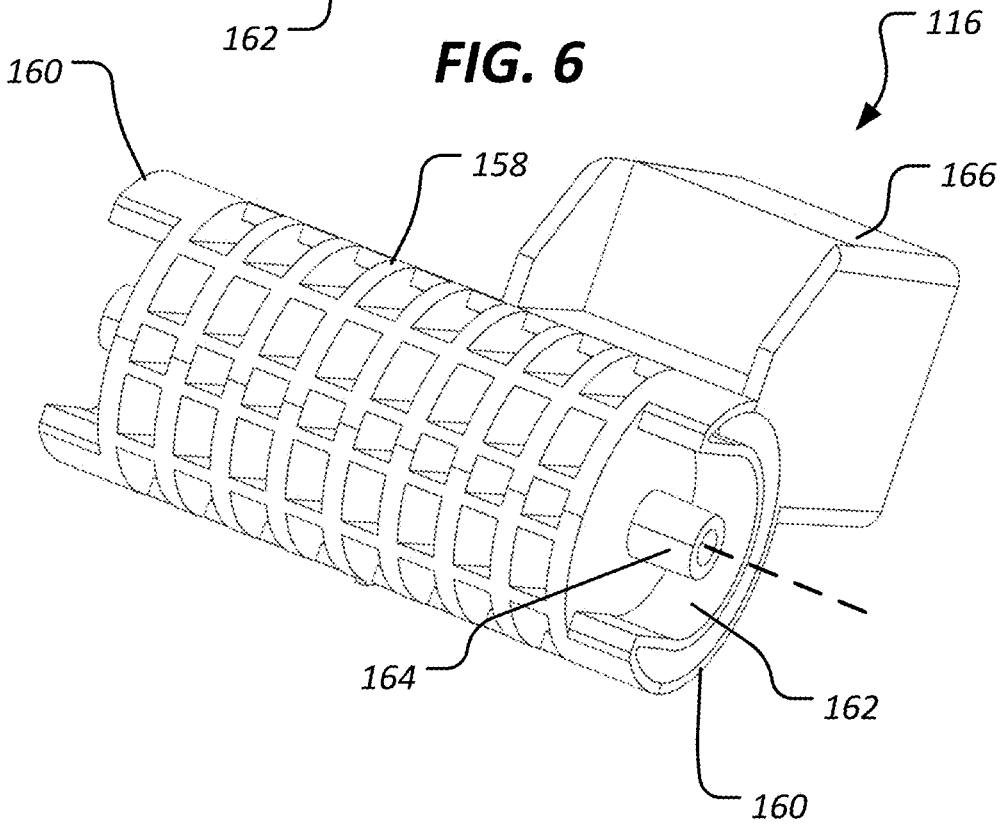
FIG. 7 is another oblique view of the hinge component of FIG. 6.

Referring now to FIGS. 6 and 7, a right-rear hinge component 116 is shown in isolation. Right-rear hinge component 116 comprises a generally cylindrical body 158 carrying C-shaped receivers 160 having C-shaped spaces 162 and pins 164. Still further, right-rear hinge component 116 comprises a crossbar receiver 166 carried by the body 158.

Figure 8:
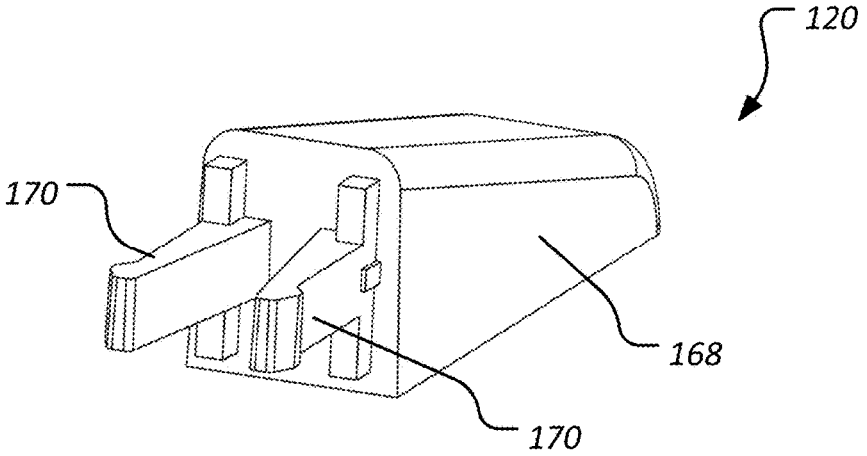
FIG. 8 is an oblique view of a stabilizer foot of the bedding standoff of FIG. 1.

Referring now to FIG. 8, a right stabilizer foot 120 is shown in isolation. Right stabilizer foot 120 comprises a ramp-shaped body 168 and two opposing flexible hooks 170.

To assemble bedding standoff 100, hinge components 110, 112 can be secured to left leg 102 by mating hinge components 110, 112 to respective knuckles 130, 132, 134 by inserting pins 164 into C-slots 138 and simultaneously inserting C-shaped protrusions 136 into C-shaped spaces 162. Subsequently, hinge components 110, 112 can be rotated about left leg axis of rotation 122 so that crossbar receivers 166 pass through respective front and rear cutouts 140, 142. After sufficient rotation, crossbars 106, 108 can be inserted into crossbar receivers 166 and the crossbars 106, 108 serve as a blocking mechanism to prevent accidental separation of the hinge components. Similar actions can be taken to join hinge components 114, 116 to right leg 104. Next, crossbars 106, 108 can be inserted into respective crossbar receivers 166. Finally, stabilizer feet 118 and 120 can be attached to legs 102, 104 by inserting hooks 170 into foot receivers 148 until hooks 170 catch on foot catches 150. With bedding standoff 100 assembled as described above, legs 102, 104 can be rotated about axes 122, 124 to obtain the desired configuration.

Figure 9:
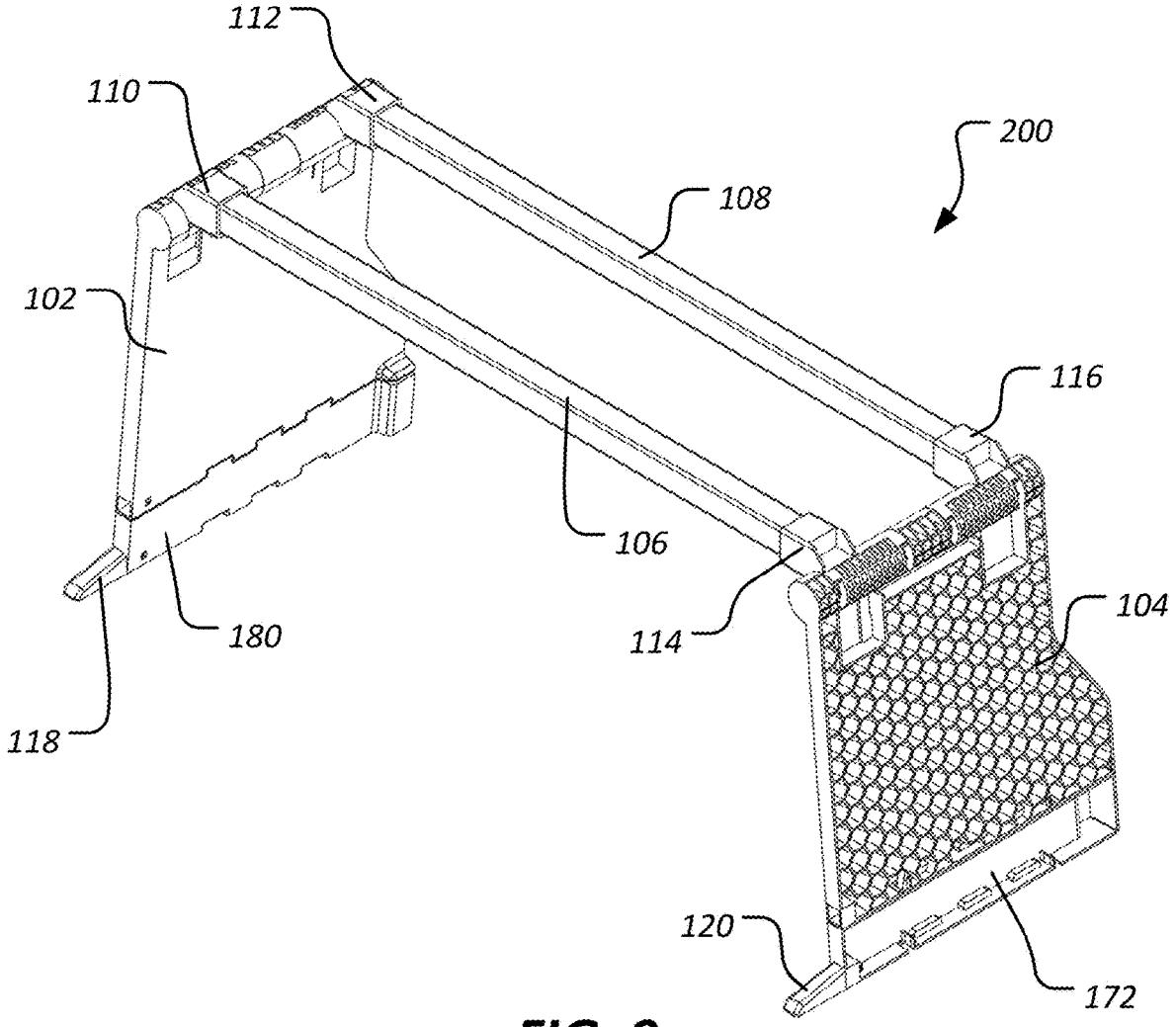
FIG. 9 is an oblique view of a bedding standoff according to another embodiment of this disclosure with the bedding standoff in a deployed configuration.
Figure 10:
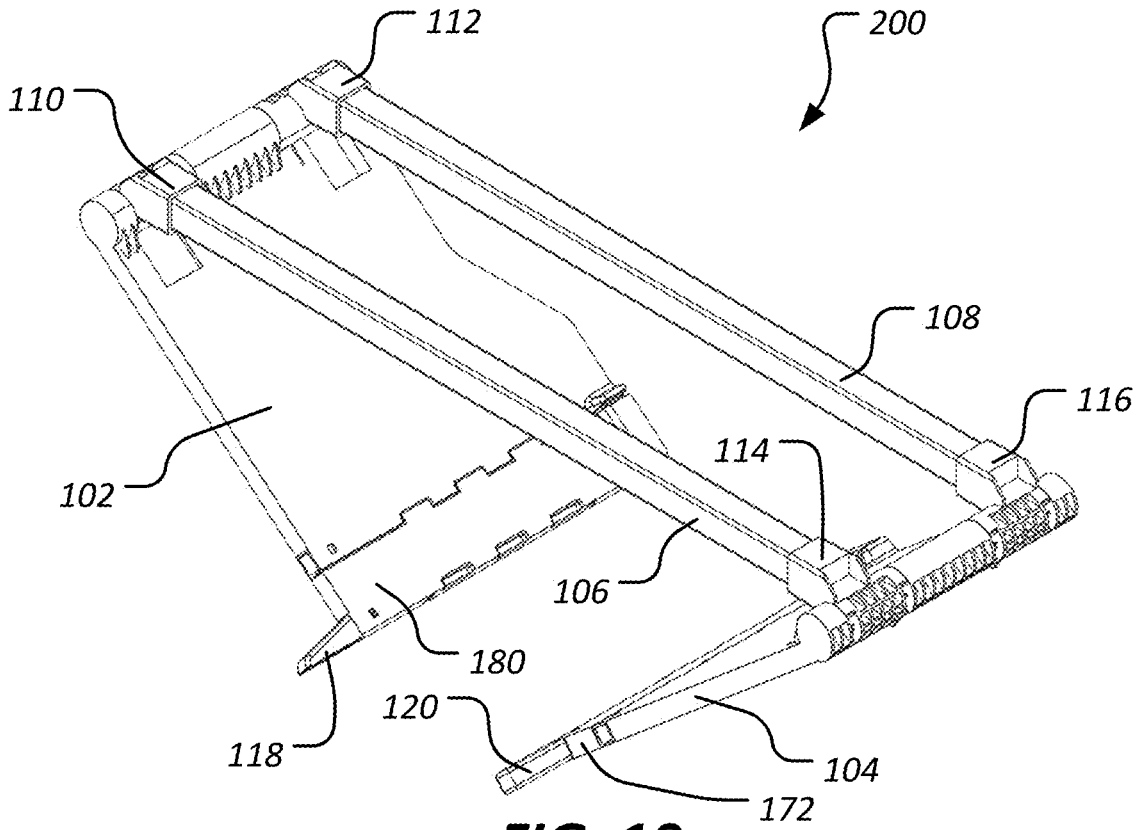
FIG. 10 is an oblique view of the bedding standoff of FIG. 9 in a partially collapsed configuration.
Figure 11:
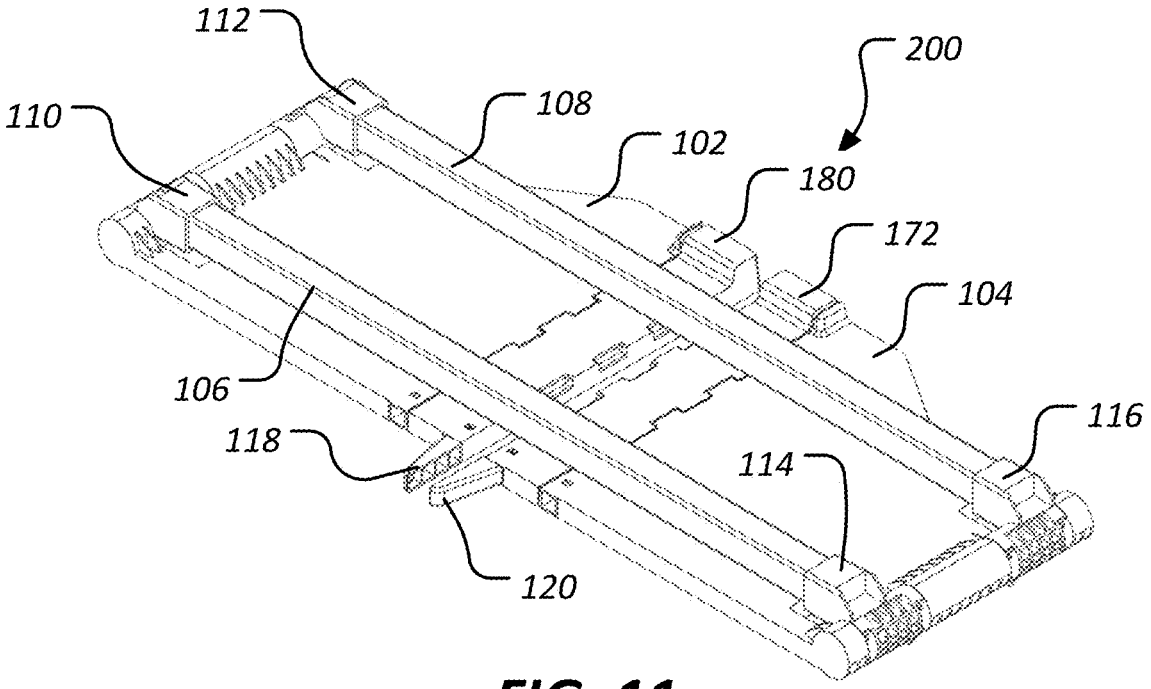
FIG. 11 is an oblique view of the bedding standoff of FIG. 9 in a fully collapsed configuration.

Referring now to FIGS. 9-11, an alternative embodiment of a bedding standoff 200 is shown. Bedding standoff 200 is substantially similar to bedding standoff 100, but additionally comprises a right extender 172 and left extender 180 attached to the base sides of the legs. Further, stabilizer feet are attached to the leg extenders instead of the legs. Most generally, extenders can optionally increase an overall height of bedding standoff 200 as compared to an overall height of bedding standoff 100. In other alternative embodiments, additional extenders can be attached to the base of other extenders to still further optionally increase an overall height of a bedding standoff to even greater heights than that of bedding standoff 200. It will be appreciated that left extender 180 that is a mirror construction of right extender 172.

Figure 12:
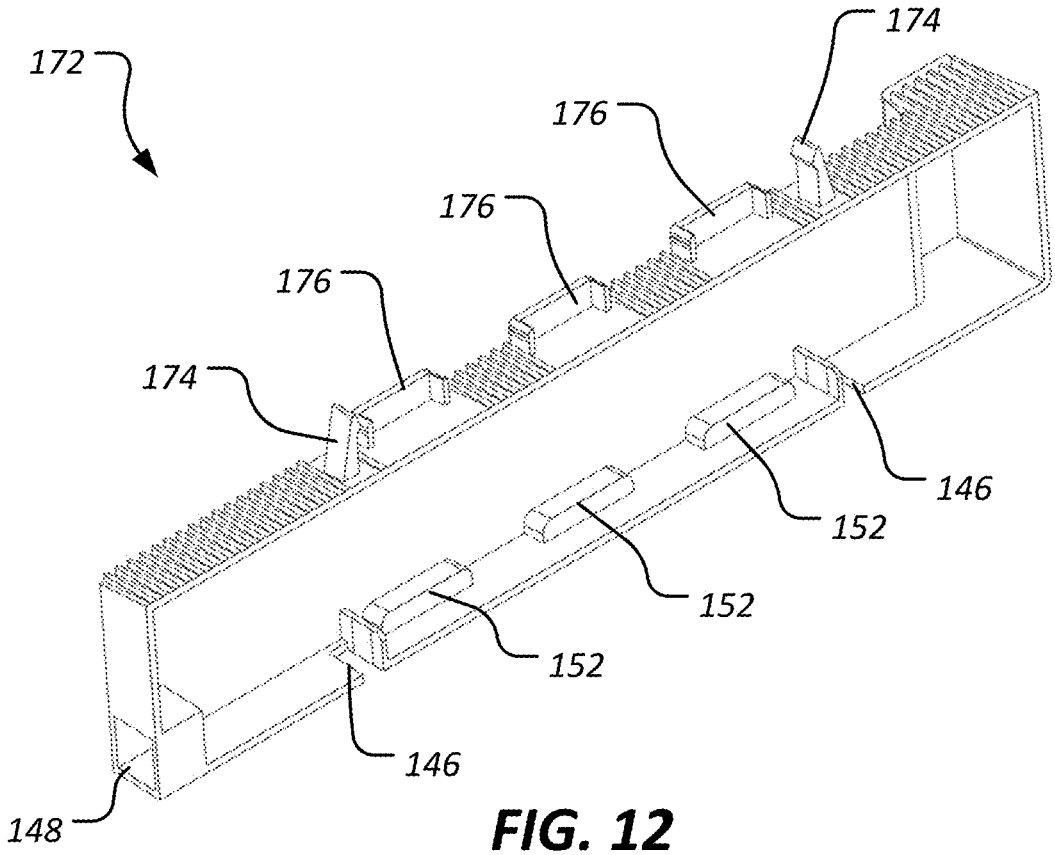
FIG. 12 is an oblique view of a leg extension of the bedding standoff of FIG. 9.
Figure 13:
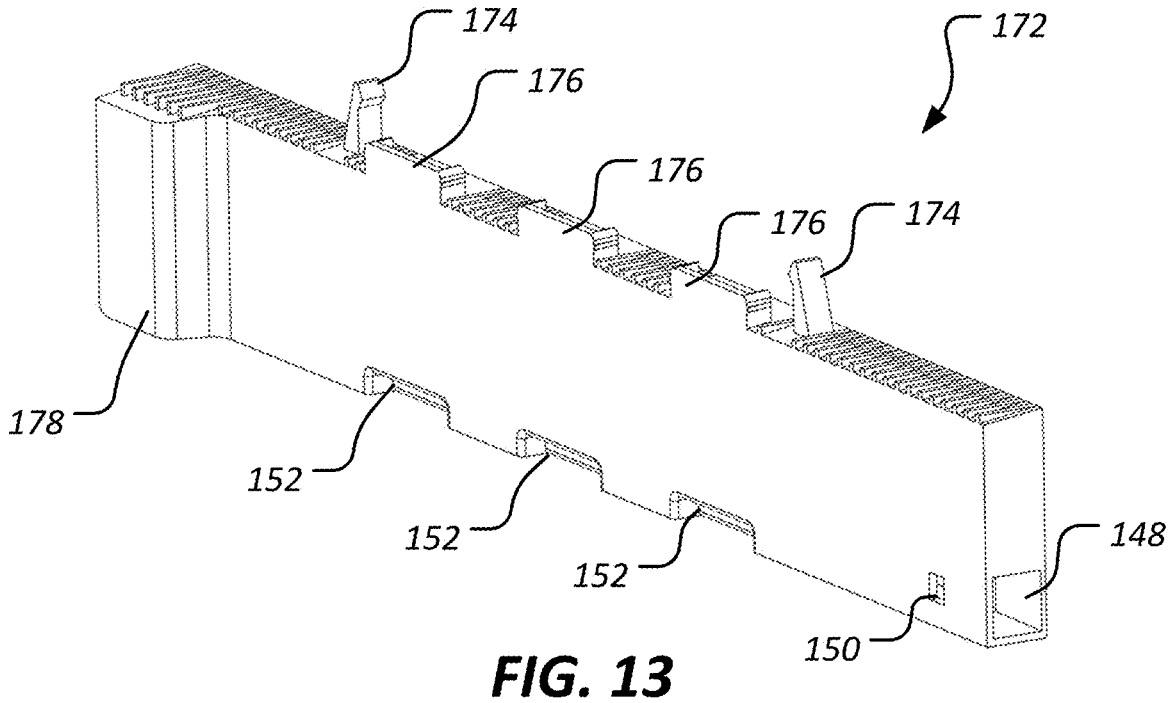
FIG. 13 is another oblique view of the leg extension of FIG. 12.

Referring now to FIGS. 12 and 13, a right extender 172 is shown in isolation. Right extender 172 comprises upper hooks 174, upper protrusions 176, and an elongated integrated foot 178.

To assemble bedding standoff 200, hinge components 110, 112 can be secured to left leg 102 by mating hinge components 110, 112 to respective knuckles 130, 132, 134 by inserting pins 164 into C-slots 138 and simultaneously inserting C-shaped protrusions 136 into C-shaped spaces 162. Subsequently, hinge components 110, 112 can be rotated about left leg axis of rotation 122 so that crossbar receivers 166 pass through respective front and rear cutouts 140, 142. After sufficient rotation, flexible tabs 156 will, after deflecting to allow passage of crossbar receivers 166, return to their undeflected positions and serve as a locking mechanism to prevent accidental separation of the hinge components 110, 112 from left leg 102. Similar actions can be taken to join hinge components 114, 116 to right leg 104. Next, extenders 172, 180 can be added to legs 102, 104 by vertically inserting hooks 174 of extenders into base vertical slots 146 of legs and upper protrusions 176 of extenders into base side slots 152 of legs. Next, crossbars 106, 108 can be inserted into respective crossbar receivers 166. Finally, stabilizer feet 118 and 120 can be attached to extenders 172, 180 by inserting hooks 170 into foot receivers 148 until hooks 170 catch on foot catches 150. With bedding standoff 200 assembled as described above, legs 102, 104 can be rotated about axes 122, 124 to obtain the desired configuration.

It will be appreciated that extenders can be connected to other extenders by inserting upper hooks 174 into base vertical slots 146 of extenders and inserting upper protrusions 176 into base side slots 152 of extenders.

Figure 14:
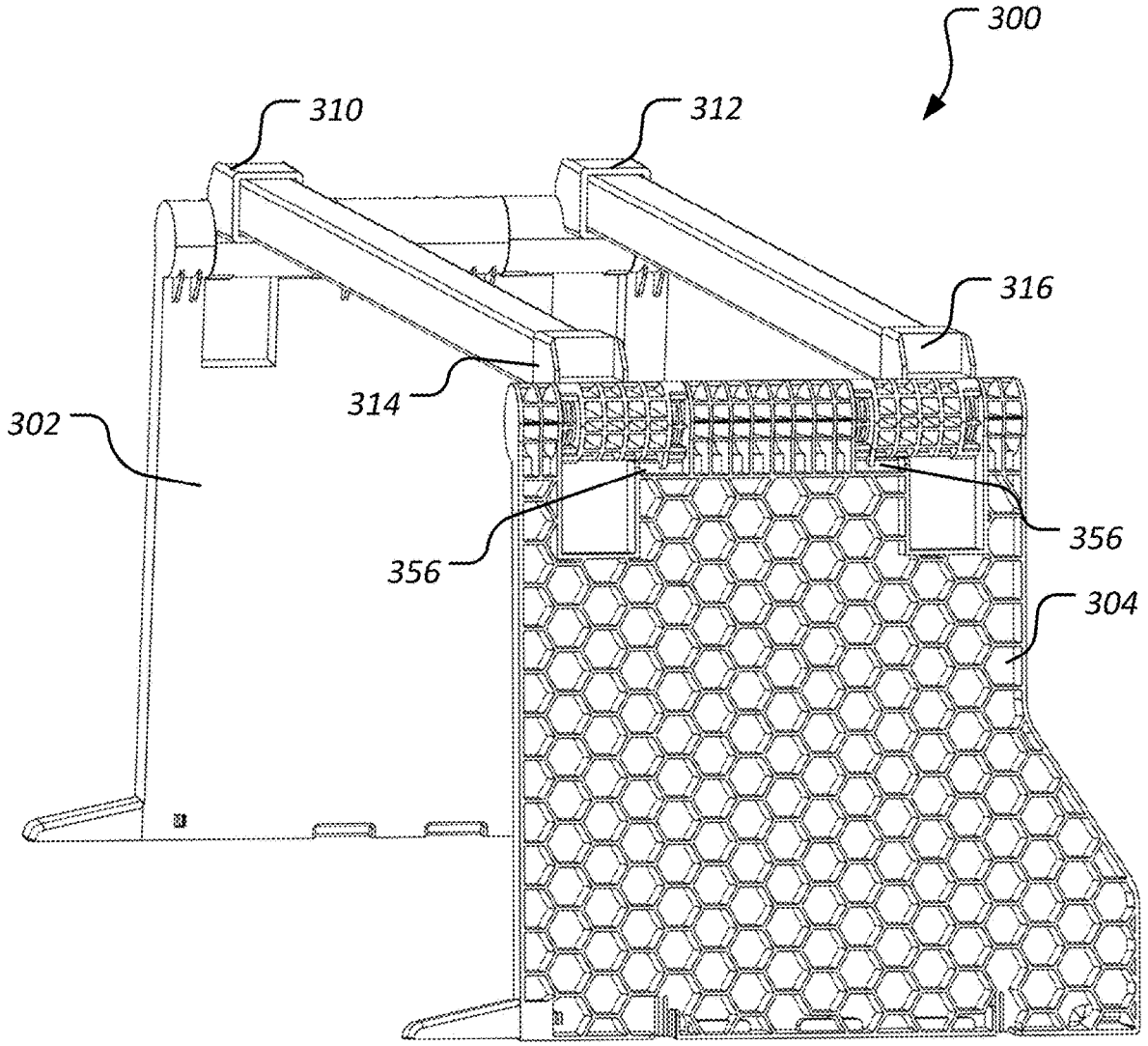
FIG. 14 is an oblique view of a bedding standoff according to another embodiment of this disclosure with the bedding standoff in a deployed configuration.
Figure 15:
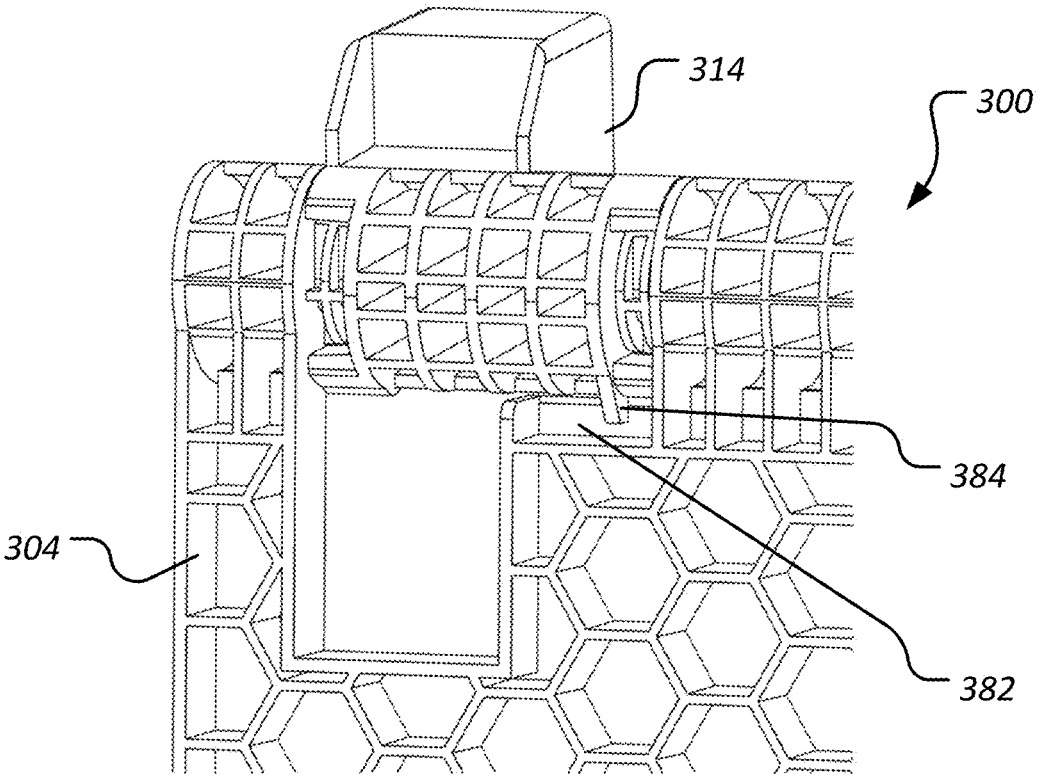
FIG. 15 is a partial oblique view of the bedding standoff of FIG. 14.

Referring now to FIGS. 14 and 15, an alternative embodiment of a bedding standoff 300 is shown. Bedding standoff 300 is substantially similar to bedding standoff 100, but comprises different hinge components 310, 312, 314, 316 as compared to hinge components 110, 112, 114, 116 and lacks flexible tabs 156. Instead, bedding standoff 300 comprises legs 302, 304 that comprise rotation stop walls 382 and hinge components 310, 312, 314, 316 that comprise rotation catches 384 and rotation bumps 386.

Figure 16:
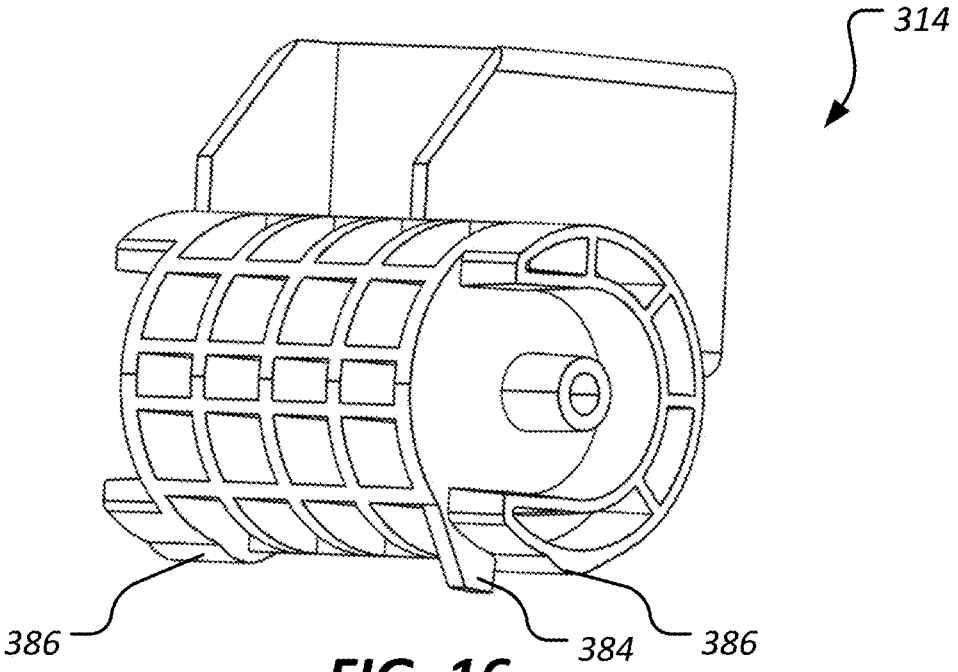
FIG. 16 is an oblique view of a hinge component of the bedding standoff of FIG. 14.

Referring now to FIG. 16, hinge component 314 is shown in isolation. Hinge component 314 is substantially similar to hinge component 114, but further comprises the aforementioned rotation catch 384 and rotation bumps 386. In operation, upon sufficient rotation of the hinge component 314 relative to leg 304, further rotation of the hinge component 314 relative to leg 304 is inhibited by contact between hinge component 314 and rotation stop wall 382. Further, rotation bumps 386 are sized to allow passage of the rotation bumps 386 through a gap between the hinge component 314 and the leg 304, but with additional rotational force required thereby indicating to a user that a particular orientation has been achieved and to prevent unintentional rotation of the hinge component 314 from the particular orientation by rotationally capturing the stop wall 382 between the rotation catch 384 and an associated rotation bump 386. In this embodiment, the particular orientation is a fully deployed position, however, in alternative embodiments, rotation bumps can be differently placed or additionally placed to provide different or additional tactile positional feedback to a user.

After assembling bedding standoffs 100, 200, 300 they can be used to provide a space for protecting feet or other body parts from bedding by resting the bedding standoffs 100, 200, 300 atop a mattress and/or base bedding and thereafter applying sheets, covers, comforters, and/or other bedding to a bed over the bedding standoff 100, 200, 300. Accordingly, bedding standoffs 100, 200, 300 can provide a volumetric space in which feet and/or other body parts can reside without contacting bedding applied above the bedding standoffs 100, 200, 300.

At least one embodiment is disclosed, and variations, combinations, and/or modifications of the embodiment(s) and/or features of the embodiment(s) made by a person having ordinary skill in the art are within the scope of this disclosure. Alternative embodiments that result from combining, integrating, and/or omitting features of the embodiment(s) are also within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_{EL}$, and an upper limit, $R_u$, is disclosed, any number falling within the range is specifically disclosed. In particular, the following numbers within the range are specifically disclosed: $R=R_s+k*(R_u-R_1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 95 percent, 98 percent, 99 percent, or 100 percent. Moreover, any numerical range defined by two R numbers as defined in the above is also specifically disclosed.

Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention. Also, the phrases "at least one of A, B, and C" and "A and/or B and/or C" should each be interpreted to include only A, only B, only C, or any combination of A, B, and C.

What is claimed is:

1. A bedding standoff, comprising:

a first plate-shaped leg;

a second plate-shaped leg offset from the first plate-shaped leg;

a crossbar connecting the first plate-shaped leg to the second plate-shaped leg near a top of the first plate-shaped leg and near a top of the second plate-shaped leg; and a hinge component rotatably carried by the first plate-shaped leg, the hinge component comprising a crossbar receiver configured to receive the crossbar;

wherein the first plate-shaped leg is rotatable relative to the crossbar;

wherein the hinge component comprises a pin for being received by the first plate-shaped leg; and wherein the first plate-shaped leg comprises a C-shaped protrusion that forms a C-slot configured to receive the pin.

2. The bedding standoff of claim 1, wherein the hinge component comprises a C-shaped receiver.

3. The bedding standoff of claim 2, wherein the C-shaped receiver is configured to receive the C-shaped protrusion into a C-shaped space formed by the C-shaped receiver.

4. The bedding standoff of claim 3, wherein the first plate-shaped leg comprises a cutout for receiving the crossbar receiver therethrough during rotation of the hinge component relative to the first plate-shaped leg.

5. The bedding standoff of claim 4, wherein the first plate-shaped leg comprises a flexible tab for selectively preventing removal of the hinge component from attachment to the first plate-shaped leg.

6. The bedding standoff of claim 1, wherein the second plate-shaped leg is substantially a mirror construction of the first plate-shaped leg.

7. A bedding standoff, comprising:

a first plate-shaped leg;

a second plate-shaped leg offset from the first plate-shaped leg; and a crossbar connecting the first plate-shaped leg to the second plate-shaped leg near a top of the first plate-shaped leg and near a top of the second plate-shaped leg;

a plate-shaped extender connected to a base of the first plate-shaped leg; and at least one of (1) wherein the plate-shaped extender comprises an upper hook received by a base vertical slot of the first plate-shaped leg and (2) wherein the plate-shaped extender comprises an upper protrusion received by a base side slot of the first plate-shaped leg.

8. A bedding standoff, comprising:

a first leg;

a second leg offset from the first leg;

a crossbar connecting the first leg to the second leg near a top of the first leg and near a top of the second leg; and a hinge component rotatably carried by the first leg, the hinge component comprising a crossbar receiver configured to receive the crossbar;

wherein the first leg is rotatable relative to the crossbar;

wherein the hinge component comprises a pin for being received by the first leg;

wherein the first leg comprises a C-shaped protrusion that forms a C-slot configured to receive the pin; and wherein the hinge component comprises a C-shaped receiver.

* * * * *